US009627775B2

(12) United States Patent
Nakatsu et al.

(10) Patent No.: US 9,627,775 B2
(45) Date of Patent: Apr. 18, 2017

(54) MICROSTRIP ANTENNA

(71) Applicant: Nippon Pillar Packing Co., Ltd., Osaka (JP)

(72) Inventors: Akira Nakatsu, Osaka (JP); Koji Onishi, Osaka (JP)

(73) Assignee: Nippon Pillar Packing Co., Ltd., Osaka (JP)

( * ) Notice: Subject to any disclaimer, the term of this patent is extended or adjusted under 35 U.S.C. 154(b) by 63 days.

(21) Appl. No.: 14/252,009

(22) Filed: Apr. 14, 2014

(65) Prior Publication Data

US 2014/0306846 A1 Oct. 16, 2014

(30) Foreign Application Priority Data

Apr. 16, 2013 (JP) ..... 2013-086152

(51) Int. Cl.

| | |
|---|---|
| ***H01Q 9/04*** | (2006.01) |
| ***H01Q 21/00*** | (2006.01) |
| ***H01Q 21/08*** | (2006.01) |
| ***H01Q 21/29*** | (2006.01) |
| ***H01Q 21/30*** | (2006.01) |

(52) U.S. Cl.
CPC ..... *H01Q 21/0075* (2013.01); *H01Q 21/08* (2013.01); *H01Q 21/29* (2013.01); *H01Q 21/30* (2013.01)

(58) Field of Classification Search
USPC ..... 343/700 MS, 702; 428/201
See application file for complete search history.

(56) References Cited

U.S. PATENT DOCUMENTS

| | | | | |
|---|---|---|---|---|
| 3,757,343 A * | 9/1973 | Bogner | ..... | H01Q 11/04 343/770 |
| 6,369,762 B1 * | 4/2002 | Yanagisawa | ..... | H01Q 1/38 343/700 MS |
| 6,624,793 B1 * | 9/2003 | Su | ..... | H01Q 9/28 343/793 |

(Continued)

FOREIGN PATENT DOCUMENTS

| | | |
|---|---|---|
| JP | H05-167336 A | 7/1993 |
| JP | H07-193414 A | 7/1995 |

(Continued)

*Primary Examiner* — Hoang Nguyen
*Assistant Examiner* — Hai Tran
(74) *Attorney, Agent, or Firm* — Kilyk & Bowersox, P.L.L.C.

(57) ABSTRACT

To provide a microstrip antenna that can radiate electromagnetic waves in two or more different directions while suppressing an increase in manufacturing cost. The microstrip antenna is configured to include: a dielectric substrate 10 that is adapted to be of a folded flat plate shape; two or more radiating patterns 2 for radiating electromagnetic waves; and a connecting pattern 3 for mutually connecting the radiating patterns 2 and feeding electricity from a common feeding point 4 to each of the radiating patterns 2. The radiating patterns 2 and connecting pattern 3 are respectively adapted as microstrip lines formed on the dielectric substrate 10, and the dielectric substrate 10 is folded such that the connecting pattern 3 intersects with a ridge line 5, and has two or more radiating surfaces 10*a* to 10*c* of which normal directions are mutually different.

6 Claims, 7 Drawing Sheets

MICROSTRIP ANTENNA 1

(56) References Cited

U.S. PATENT DOCUMENTS

| | | | | |
|---|---|---|---|---|
| 2008/0311358 | A1* | 12/2008 | Tomii | B32B 15/14 428/201 |
| 2009/0109118 | A1* | 4/2009 | Ma | H01Q 1/243 343/876 |
| 2010/0045550 | A1* | 2/2010 | Kaneda | H01Q 9/0442 343/745 |
| 2010/0066615 | A1* | 3/2010 | Okayama | H01Q 1/243 343/702 |
| 2013/0027259 | A1 | 1/2013 | Fujita et al. | |

FOREIGN PATENT DOCUMENTS

| | | | |
|---|---|---|---|
| JP | H10-051215 | A | 2/1998 |
| JP | 2007-074206 | A | 3/2007 |
| JP | 2007-180819 | A | 7/2007 |
| JP | 2013-31064 | | 2/2013 |

* cited by examiner

A-A CROSS SECTIONAL VIEW

MICROSTRIP ANTENNA

CROSS REFERENCE

This application claims the benefit of JP2013-086152 filed on Apr. 16, 2013 which is incorporated herein by reference in its entity.

TECHNICAL FIELD

The present invention relates to a microstrip antenna, and more particularly, to the improvement of a microstrip antenna in which a radiating pattern for radiating electromagnetic waves is formed on a dielectric substrate, such as a microstrip antenna usable for application such as communication using radio waves in a microwave or milliwave band.

BACKGROUND SECTION OF THE INVENTION

A microstrip antenna is a small-sized light-weight antenna that uses an MSL (microstrip line) formed on a dielectric substrate to transceive radio waves in a microwave or milliwave band, and used as a surveillance radar antenna or a communication antenna. For example, an MSL is configured to include a substantially linear feed line, a plurality of radiating elements arranged along the feed line, and a ground layer formed through a dielectric layer.

A conventional microstrip antenna is a planar antenna in which a radiating pattern and a feeding point constituting an MSL are formed on a front surface of a dielectric substrate and a ground layer is formed on a back surface side of the dielectric substrate, and can radiate electromagnetic waves only in one direction intersecting with the dielectric substrate (e.g., Patent Literature 1 (JP-A-2013-31064)). For this reason, in order to radiate electromagnetic waves in two or more different directions, it is necessary to arrange a plurality of microstrip antennas in mutually different directions, and feed high frequency signals to the microstrip antennas.

That is, in the case of attempting to radiate the electromagnetic waves in the two or more directions, it is necessary to fabricate a plurality of dielectric substrates, which gives rise to a problem of increased manufacturing costs. Also, in the case of distributing the high frequency signals to the respective dielectric substrates, and then feeding the high frequency signals to the respective microstrip antennas, there is a problem of a complicated configuration of transmission lines that connect a high frequency circuit and the microstrip antennas to each other.

On the other hand, in the case of distributing the high frequency signals on any of the dielectric substrates, and then feeding the high frequency signals to the respective microstrip antennas, MSLs should be connected between the dielectric substrates, and therefore connectors for MSL connection should be separately provided. For this reason, there are problems of increased manufacturing costs and also large power loss.

SUMMARY SECTION OF THE INVENTION

The present invention is made in consideration of the above-described situations, and intended to provide a microstrip antenna that can radiate electromagnetic waves in two or more different directions while suppressing manufacturing costs.

Also, the present invention is intended to provide a microstrip antenna that enables the connection with a high frequency circuit to be simplified and power loss to be suppressed.

A microstrip antenna according to a first aspect of the present invention is configured to be provided with: two or more radiating patterns for radiating electromagnetic waves; and a connecting pattern for mutually connecting the radiating patterns and feeding electricity from a common feeding point to each of the radiating patterns, wherein: the radiating patterns and the connecting pattern are adapted as microstrip lines formed on a dielectric substrate; and the dielectric substrate is adapted to be of a flat plate shape that is folded such that the connecting pattern intersects with a ridge line, and has two or more radiating surfaces of which normal directions are mutually different.

In the microstrip antenna, the two or more radiating surfaces of which the normal directions are mutually different are formed by folding the dielectric substrate, and on the radiating surfaces, the radiating patterns are respectively formed. For this reason, as compared with the case of forming two or more radiating surfaces respectively on different dielectric substrates, manufacturing cost can be suppressed, and also miniaturization can be realized. Also, it is not necessary to connect two or more dielectric substrate to a high frequency circuit, and therefore power loss can be suppressed. Further, by connecting the two or more radiating patterns to the common feeding point with use of the connecting pattern intersecting with the ridge line, as compared with the case of providing a feeding point for each radiating pattern to connect a high frequency circuit to two or more feeding points, manufacturing cost can be suppressed and power loss can be suppressed.

A microstrip antenna according to a second aspect of the present invention is, in addition to the above configuration, configured such that each of the radiating surfaces is adapted to be of an elongate shape; and each of the radiating patterns includes: a substantially linear feed line that extends in a longer direction of a corresponding one of the radiating surfaces; and two or more radiating elements that are arranged along the feed line.

According to such a configuration, while suppressing an area of each of the radiating surfaces, an array antenna including the two or more radiating elements on each of the radiating surfaces is formed, and therefore it is possible to form the antenna having sharp directivity in directions respectively intersecting with the radiating surfaces.

A microstrip antenna according to a third aspect of the present invention is, in addition to the above configuration, configured such that each of the radiating surfaces is adapted to be of an elongate shape of which a longer direction is a direction substantially parallel to the ridge line. According to such a configuration, a size of the dielectric substrate in a direction intersecting with the ridge line can be decreased.

A microstrip antenna according to a fourth aspect of the present invention is, in addition to the above configuration, configured such that each of the radiating surfaces is adapted to be of an elongate shape of which a longer direction is a direction intersecting with the ridge line. According to such a configuration, a size of the dielectric substrate in the ridge line direction can be decreased.

A microstrip antenna according to a fifth aspect of the present invention is, in addition to the above configuration, configured such that the dielectric substrate is made of fluorine resin containing inorganic fiber. According to such a configuration, it is possible to reduce dielectric loss while ensuring mechanical strength of the dielectric substrate.

A microstrip antenna according to a sixth aspect of the present invention is, in addition to the above configuration, configured such that on the dielectric substrate, a ground layer covering a back surface is formed, and a slit is formed in a location of the ground layer, which faces to the ridge line. According to such a configuration, a process for folding the dielectric substrate along the ridge line can be facilitated.

The microstrip antenna according to the present invention can radiate radio waves in two or more different directions while suppressing manufacturing costs. Also, it is not necessary to connect two or more dielectric substrates to a high frequency circuit, and therefore the connection with the high frequency circuit can be simplified to suppress power loss.

DETAILED DESCRIPTION OF THE INVENTION

<Microstrip Antenna 1>

Figure 1:
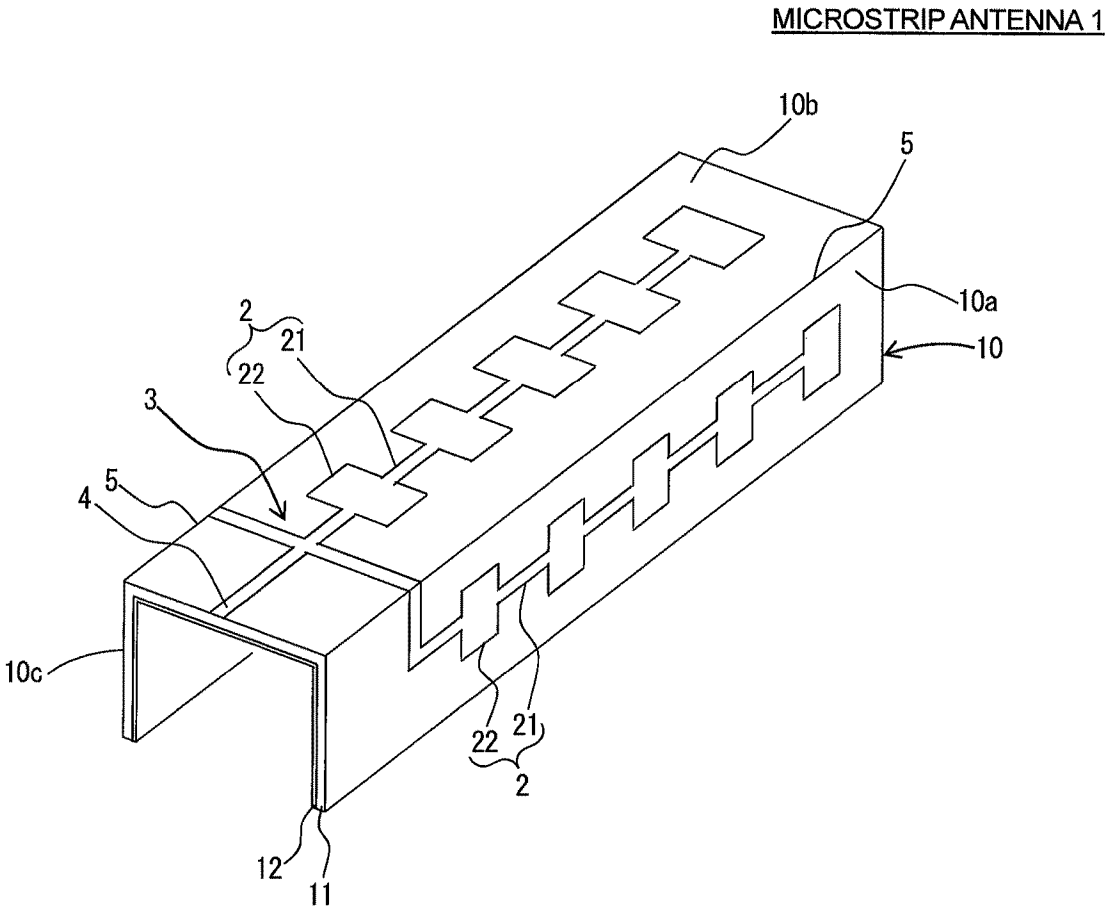
FIG. 1 is a perspective view illustrating a configuration example of a microstrip antenna 1 according to an embodiment of the present invention.

FIG. 1 is a perspective view illustrating a configuration example of a microstrip antenna 1 according to an embodiment of the present invention. The microstrip antenna 1 is a small-sized light-weight antenna suitable for transmitting or receiving radio waves in a frequency band of UHF (Ultra High Frequency) or high frequency, and can be used as a communication or radar antenna. In particular, the microstrip antenna 1 is preferable for transceiving radio waves in a milliwave band (frequency of 30 GHz to 300 GHz).

The microstrip antenna 1 is configured to include: a dielectric substrate 10 of a folded flat plate shape; two or more radiating patterns 2 formed on the dielectric substrate 10; and a connecting pattern 3.

The dielectric substrate 10 is an antenna substrate configured to include a dielectric layer 11 made of a dielectric having a small dielectric constant, and a ground layer 12 made of a conductor, and on the dielectric layer 11, the radiating patterns 2 and the connecting pattern 3 are formed. The ground layer 12 is formed so as to cover the entire back surface of the dielectric substrate 10, and forms an earth plate.

Each of the radiating patterns 2 is an electrode pattern for radiating the electromagnetic waves, and includes a feed line 21 for transmitting high frequency signals, and radiating elements 22 for radiating the high frequency signals to free space. The connecting pattern 3 is an electrode pattern for mutually connecting the radiating patterns 2 and feeding electricity from a common feeding point 4 to the respective radiating patterns 2. In this embodiment, the connecting pattern 3 serves as a branching circuit that connects the feeding point 4 to the respective radiating patterns 2, and when high frequency signals are inputted to the feeding point 4, distributes the high frequency signals for the respective radiating patterns 2 to feed the high frequency signals to one ends of the radiating patterns.

The radiating patterns 2 and connecting pattern 3 are all arranged so as to face to the ground layer 12 through the dielectric layer 11, and constitute a MSL. The feeding point 4 is connected to a high frequency circuit (not illustrated). To connect the feeding point 4 and the high frequency circuit to each other, a well-known method can be used. For example, by providing a matching element electromagnetically coupled to a waveguide or a strip line as the feeding point 4, power can be transmitted between the microstrip antenna 1 and the high frequency circuit with low loss.

In the microstrip antenna 1, by folding the dielectric substrate 10 such that the connecting pattern 3 intersects with ridge lines 5, three radiating surfaces 10*a* to 10*c* and the two ridge lines 5 are formed. That is, a cross section formed in the case of cutting the dielectric substrate 10 along a plane intersecting with the ridge lines 5 is of a substantially U-shape. Considering dielectric loss, a thickness of the dielectric substrate 10 is preferably about 25 μm.

Each of the radiating surfaces 10*a* to 10*c* is a substrate surface having an elongate shape of which a longer direction is substantially parallel to the ridge lines 5, and on each of the radiating surfaces 10*a* to 10*c*, at least one radiating pattern 2 is arranged. The respective radiating surfaces 10*a* to 10*c* face in mutually different directions, and are adjacent through the ridge lines 5. That is, the radiating surfaces 10*a* and 10*b* are arranged so as to be adjacent to each other through a corresponding one of the ridge lines 5, whereas the radiating surfaces 10*b* and 10*c* are arranged so as to be adjacent to each other through the other ridge line 5. By mutually differentiating the directions normal to the respective radiating surfaces 10*a* to 10*c* radiating the electromagnetic waves, the electromagnetic waves can be radiated in the two or more different directions.

Also, a feed line 21 of each of the radiating patterns 2 is a substantially linear transmission line extending in a longer direction of a corresponding one of the radiating surfaces 10*a* to 10*c*, and along the feed line 21, two or more radiating elements 22 are arranged. That is, a radiating pattern 2 on each of the radiating surfaces 10*a* to 10*c* forms a planar array antenna, and by arranging respective radiating elements 22 so as to utilize interference to mutually intensify the electromagnetic waves radiated from the plurality of radiating elements 22, sharp directivity is realized in a predetermined direction intersecting with the radiating surface 10*a* to 10*c*.

Each of the feed lines 21 includes a linearly shaped area that extends with keeping a constant width, of which one end is connected to the connecting pattern 3. Each of the radiating elements 22 includes an area of a shape formed by widening the line width of a feed line 21, for example, an area of a rectangular shape formed by protruding parts of lateral sides of a feed line 21 outward. A length by which each of the parts of the lateral sides of the feed line 21 is protruded to form the radiating element 22 is determined depending on a wavelength of the electromagnetic waves to be resonated.

In this example, each of the radiating surfaces 10*a* to 10*c* is a substantially rectangular-shaped substrate surface of which one or both long sides serve as the ridge lines 5, and any adjacent two of the radiating surfaces intersect with each other at a substantially right angle. By folding the dielectric substrate 10 so as to make an intersecting angle between any adjacent two of the radiating surfaces equal to the substantially right angle as described, the sharp directivity can be realized in each of the three directions any adjacent two of which are orthogonal to each other in a plane perpendicular to the longer directions of the radiating surfaces 10*a* to 10*c*.

Also, on each of the radiating surfaces 10*a* to 10*c*, one radiating pattern 2 is arranged, and one end of the radiating pattern 2 is connected to the connecting pattern 3. That is, electricity is fed from the one end to the other end of the radiating pattern 2, and feeding directions of the respective radiating patterns 2 are the same.

Also, the feeding point 4 is provided on the central radiating surface 10*b*. Specifically, part of the connecting pattern 3 is formed so as to be extended toward one of short sides of the radiating surface 10*b* and exposed from an end surface on the short side of the dielectric substrate 10, and near the short side, the feeding point 4 is arranged. Note that the connecting pattern 3 does not have to be exposed from the end surface of the dielectric substrate 10.

<Folding Process of Dielectric Substrate 10>

Figure 2:
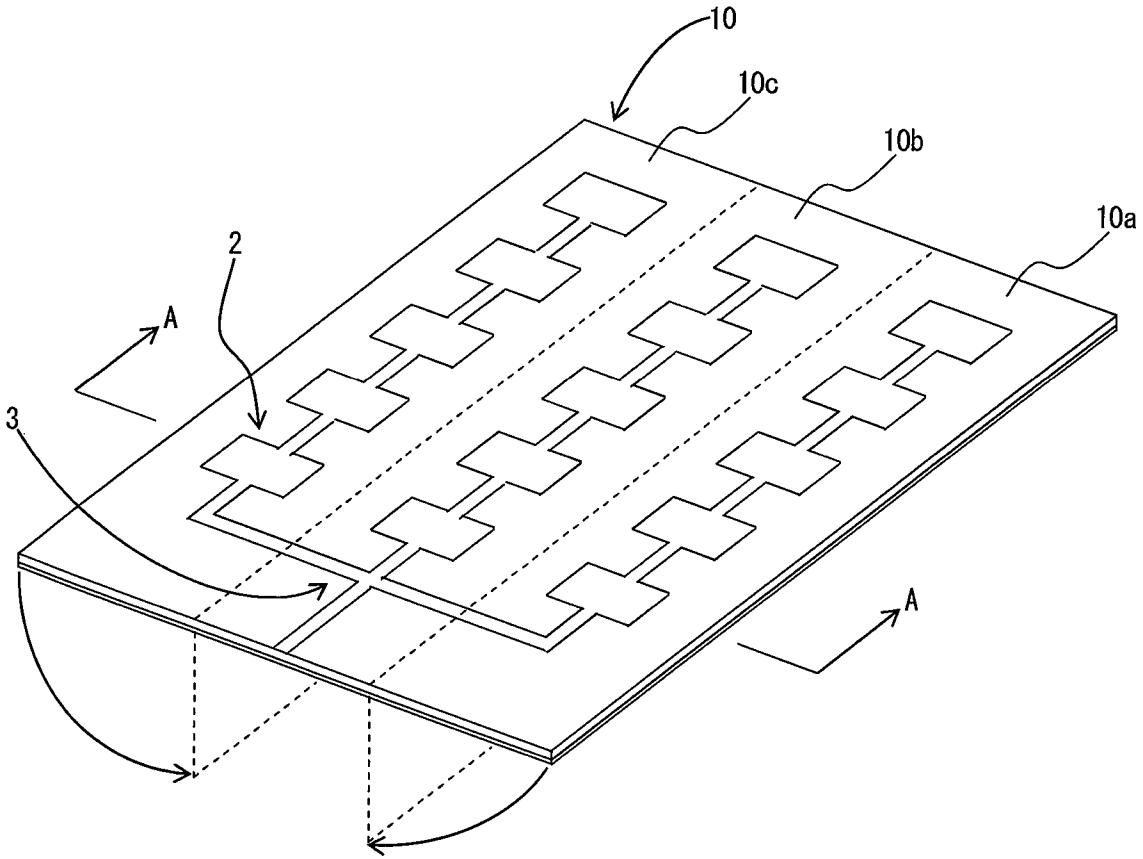
FIG. 2 is a perspective view illustrating an example of a manufacturing process of the microstrip antenna 1 in FIG. 1, in which a folding process of a dielectric substrate 10 is illustrated.
Figure 3:
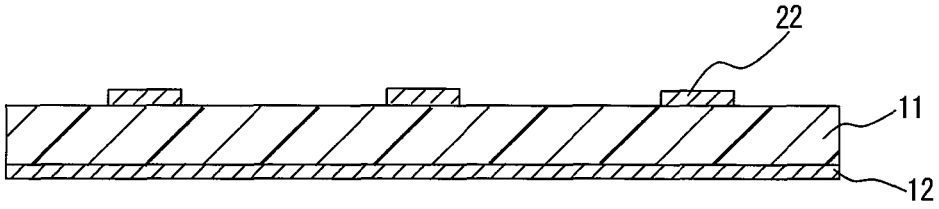
FIG. 3 is a cross-sectional view illustrating a configuration example of the dielectric substrate 10 in FIG. 2, and illustrates a cross section when cutting the dielectric substrate 10 along an A-A cutting-plane line.

FIG. 2 is a perspective view illustrating an example of a manufacturing process of the micro strip antenna 1 in FIG. 1, and illustrates a folding process of the dielectric substrate 10 formed with the radiating patterns 2 and connecting pattern 3 on the front surface. Also, FIG. 3 is a cross-sectional view illustrating a configuration example of the dielectric substrate 10 in FIG. 2, and illustrates a cross section formed in the case of cutting the dielectric substrate 10 along an A-A cutting-plane line.

The microstrip antenna 1 is prepared by forming the radiating patterns 2 and connecting pattern 3 on the front surface of the dielectric substrate 10 and then folding the dielectric substrate 10 so as to form the ridge lines connecting between the opposite end surfaces of the dielectric substrate 10 on the front surface side.

The dielectric layer 11 of the dielectric substrate 10 is made of a resin member that has appropriate rigidity and is processable in a foldable manner. For example, the dielectric layer 11 is made of fluorine resin that has a small dielectric constant and can reduce dielectric loss. The fluorine resin herein means general fluorine-contained resin, and as the fluorine resin, various types of fluorine resins can be used. For example, polytetrafluoroethylene (PTFE) may be used to form the dielectric layer 11.

In this embodiment, in order to ensure mechanical strength, the dielectric layer 11 is made of fluorine resin containing inorganic fiber. As the inorganic fiber, glass fiber or carbon fiber is available, and the dielectric layer 11 is made of a fluorine resin member reinforced by such inorganic fiber. In addition, as the resin member forming the dielectric layer 11, polyimide resin (PI) or liquid crystal polymer (LCP) can also be used.

Such a dielectric substrate 10 is formed by stacking one or two prepregs and two copper foil sheets and then performing a press process of them under high temperature vacuum. A prepreg is a sheet-like member, and manufactured from a long glass cloth through an impregnation process, sintering process, and cutting process. The impregnation process is a process of impregnating the glass cloth with the fluorine resin. The sintering process is a process of melting or softening the fluorine resin by heating to cover the glass cloth. The cutting process is a process of cutting the glass cloth into sheets having an appropriate size and shape.

One of the copper foil sheets forms into the ground layer 12, whereas the other copper foil sheet forms into the radiating patterns 2 and connecting pattern 3. The radiating patterns 2 and connecting pattern 3 are formed by employing photo-etching to pattern a metal film made of the copper foil.

In this example, on the substantially rectangular-shaped dielectric substrate 10, the three radiating patterns 2 and one connecting pattern 3 are formed. Parameters such as the line widths of the radiating and connecting patterns 2 and 3, the shape and size of each of the radiating elements 22, the number of, arrangement of, and interval between radiating elements 22 within each of the radiating patterns 2, and a thickness of the dielectric layer 11 are determined depending on required radiation characteristics.

In the folding process of the dielectric substrate 10 after the formation of the radiating patterns 2 and connecting pattern 3, the dielectric substrate 10 is folded so as to form the ridge lines on the front surface side, and form value lines on the back surface side. Adjusting the intersecting angle between any adjacent two of the radiating surfaces 10*a* to 10*c* at this time enables radiation directions of the radio waves to be arbitrarily controlled.

Figure 4:
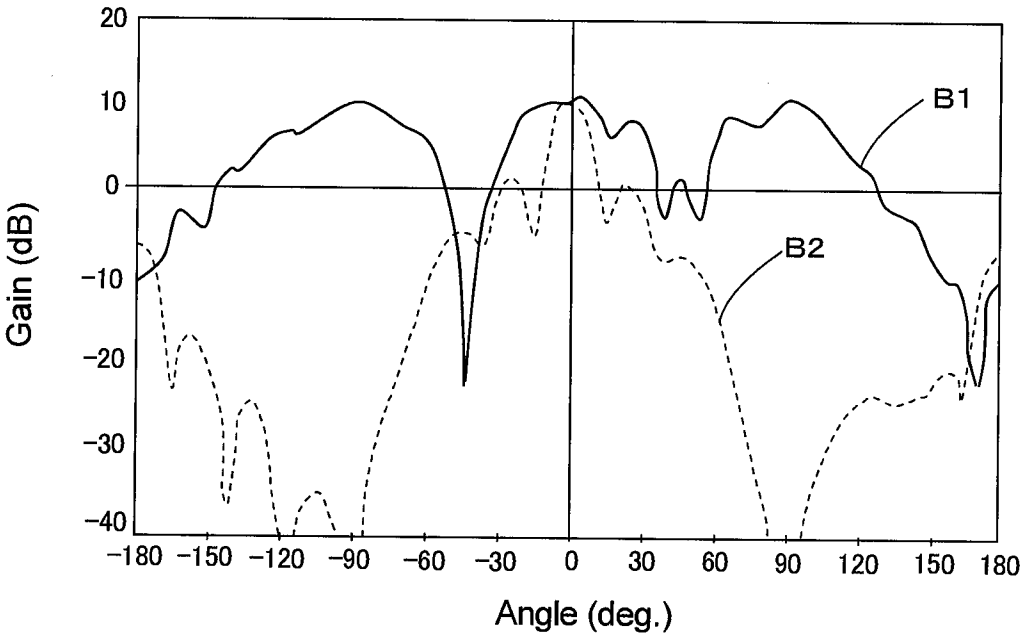
FIG. 4 is a diagram illustrating an example of directional characteristics of the microstrip antenna 1 in FIG. 1, in which vertical distribution B1 and horizontal distribution B2 of radiation gain are illustrated.

FIG. 4 is a diagram illustrating an example of directional characteristics of the microstrip antenna 1 in FIG. 1, and illustrates vertical and horizontal distributions B1 and B2 of radiation gain that is measured in a state where the radiating surface 10*b* in the center is verticalized, and the radiating surfaces 10*a* and 10*b* on the both sides are horizontalized. Curves in the diagram represent the vertical distribution B1 and the horizontal distribution B2 with the horizontal and vertical axes representing an angle (deg.) and the gain (dB), respectively. The gain is absolute gain with reference to an isotropic antenna.

The microstrip antenna 1 used for the measurement is an antenna of which the dielectric layer 11 has a thickness of 0.126 mm and a dielectric constant of 2.22, and the metal film forming the radiating patterns 2 and connecting pattern 3 has a thickness of 12 μm.

The vertical distribution B1 is a gain distribution that is shown with, in a vertical plane perpendicular to the longer directions of the radiating surfaces 10*a* to 10*c*, a normal direction of the radiating surface 10*b* being set as 0° and an elevation angle direction being set to the positive direction, in which peaks (peak values are approximately 10 dB) appear at positions of 0°, +90°, and −90°. That is, it turns out that the microstrip antenna 1 is an antenna of which radiation characteristics have, with respect to the vertical plane, sharp directivities in the front direction of the radiating surface 10*b*, and upward and downward in the vertical direction.

The horizontal distribution B2 is a gain distribution that is shown with, in the horizontal plane, the normal direction of the radiating surface 10*b* being set as 0° and one of orientation directions being set to the positive direction, in which a peak (a peak value is approximately 10 dB) of a main lobe appears at a position of 0°, and at positions of +90° and −90°, asymptotes (gains are −40 dB or less) are present. That is, it turns out that the microstrip antenna 1 is an antenna of which the radiation characteristics have, with respect to the horizontal plane, sharp directivity in the front direction of the radiating surface 10*b*.

<Portable Electronic Device 100>

Figure 5A:
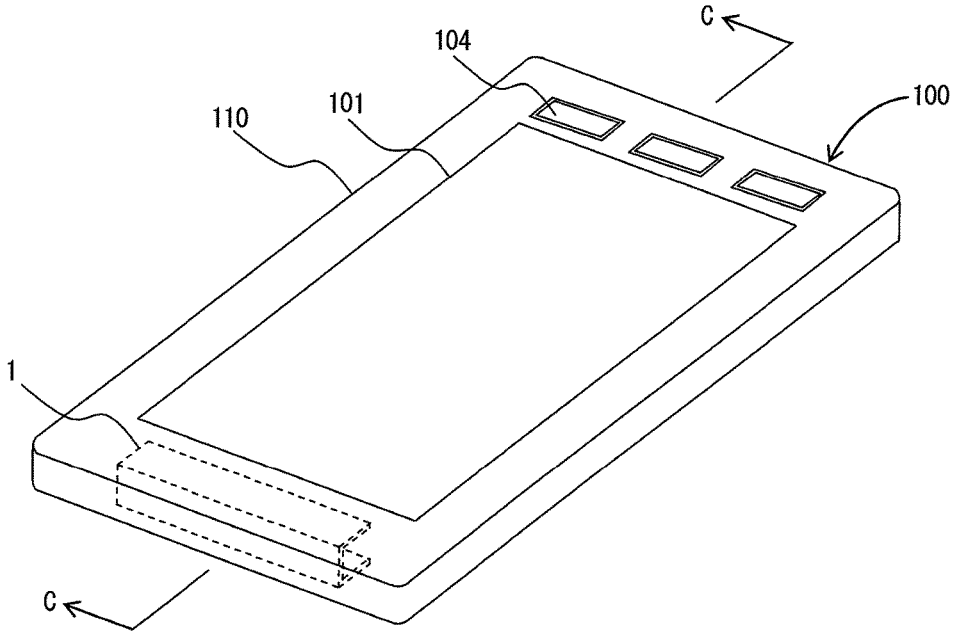
FIG. 5A is a perspective view of the illustrating an example of an electronic device 100 that contains the microstrip antenna 1 in FIG. 1 in a thin casing 110.
Figure 5B:
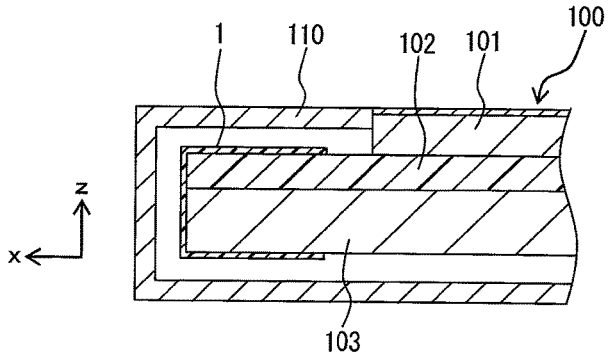
FIG. 5B is a cross-sectional view of the electronic device 100 in FIG. 5A, and illustrates a cross section when cutting the electronic device 100 along an C-C cutting-plane line.

FIG. 5A is a perspective view illustrating an example of an electronic device 100 that, in a thin casing 110, contains the microstrip antenna 1 in FIG. 1. FIG. 5B is a cross-sectional view illustrating a cross section when cutting the electronic device 100 along a C-C cutting-plane line. In this diagram, a longer direction of the thin casing 110 is set to an x direction, and a direction perpendicular to a display screen is set to a z direction.

The electronic device 100 is a portable terminal device including the thin casing 110, such as a mobile phone, PDA (Personal Digital Assistant), tablet terminal, or handheld game console, and the thin casing 110 is provided with a display device 101 having the display screen, and operation keys 104. The thin casing 110 is of a vertically long and thin rectangular parallelepiped shape. The display device 101 and the operation keys 104 are provided on a front surface of the thin casing 110.

Inside the thin casing 110, a circuit board 102 provided with a high frequency circuit for communication, and the like, and a battery 103 for feeding power to the high frequency circuit, the display device 101, and the like are contained. For example, by arranging the microstrip antenna 1 such that the radiating surfaces 10*a* and 10*c* face to a principal surface of a set of the stacked circuit board 102 and battery 103, and the radiating surface 10*b* faces to an end surface of the set of the stacked circuit board 102 and battery 103, the microstrip antenna 1 can be contained in a tiny space inside the thin casing 110. Accordingly, the electronic device 100 capable of radiating the electromagnetic waves in two or more directions can be miniaturized.

In this example, the microstrip antenna 1 is arranged in an end part on the side opposite to the operation keys 104 in the longer direction of the thin casing 110, is attached so as to surround the periphery of part of the stacked circuit board 102 and battery 103, and can be made to have the sharp directivities in three directions. Also, the electronic device 100 can emit the radio waves in the x and z directions from the end part on the side opposite to the operation keys 104 in the longer direction of the thin casing 110.

Further, by adjusting the number of radiating patterns 2 on each of the radiating surfaces 10*a* to 10*c*, and/or adjusting the number of radiating elements 22 in each of the radiating patterns 2, a communicable distance can be made difference between the x and z directions. For example, setting the communicable distance in the x direction to approximately 5 to 10 m is preferable for emitting the radio waves toward a wireless access point while performing a display operation. Also, setting the communicable distance in the z direction to approximately 5 to 10 cm is preferable for communication with a reader/writer.

According to the present embodiment, as compared with the case of forming two or more radiating surfaces respectively on different dielectric substrates, manufacturing costs can be suppressed, and also miniaturization can be realized. Also, it is not necessary to connect the two or more dielectric substrates to a high frequency circuit, and therefore power loss can be suppressed. Further, by connecting the two or more radiating patterns 2 to the common feeding point 4 with use of the connecting pattern 3 intersecting with the ridge lines 5, as compared with the case where a feeding point is provided for each radiating pattern, and a high frequency circuit is connected to the two or more feeding points, manufacturing cost can be suppressed, and also power loss can be suppressed.

Figure 6A:
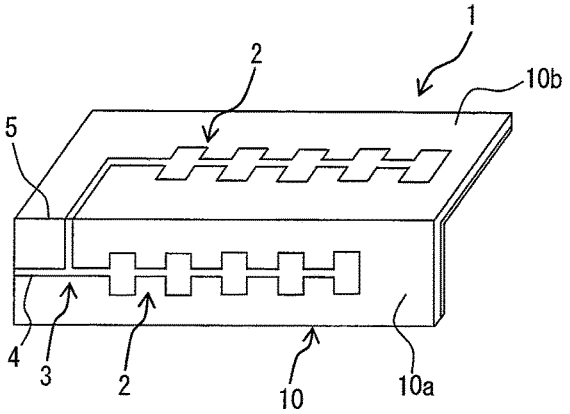
FIG. 6A to 6C are a perspective views illustrating other configuration examples of the microstrip antenna 1.
Figure 6B:
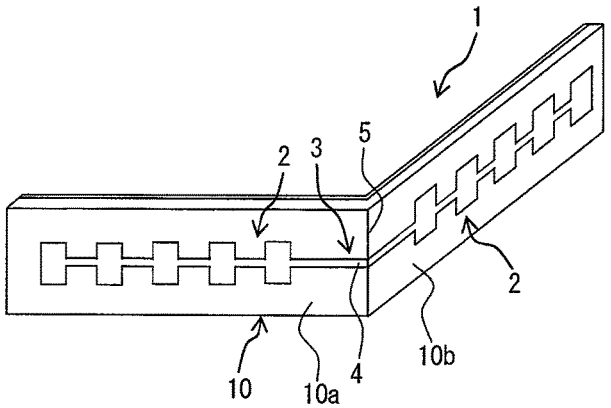
Figure 6C:
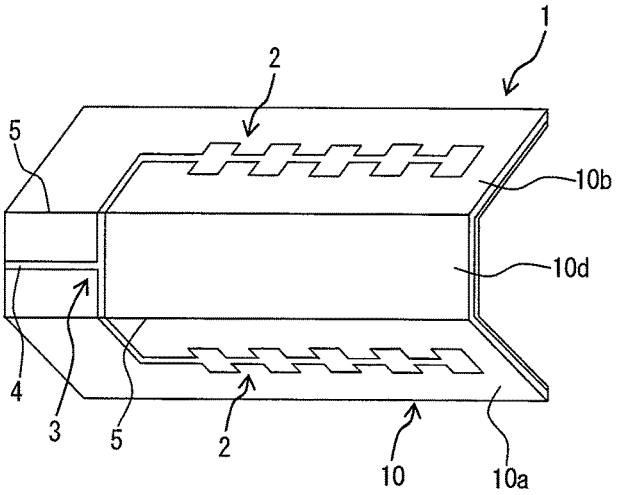

FIG. 6A to 6C are perspective views illustrating other configuration examples of the microstrip antenna 1, in which each of FIG. 6A to 6C illustrates the case where on a dielectric substrate 10, two radiating surfaces 10*a* and 10*b* are formed.

In FIG. 6A, the radiating surfaces 10*a* and 10*b* are arranged so as to be adjacent to each other through a ridge line 5 that corresponds to long sides of the radiating surfaces 10*a* and 10*b*. Also, each of the radiating surfaces 10*a* and 10*b* is of an elongate shape of which a longer direction is a direction substantially parallel to the ridge line 5, and on each of the radiating surfaces 10*a* and 10*b*, one radiating pattern 2 is formed. The dielectric substrate 10 is folded at substantially right angle along the ridge line 5, and a cross section of the dielectric substrate 10 is of a substantially L-shape. Further, a connecting pattern 3 is formed at one ends of the radiating surfaces 10*a* and 10*b* in their longer directions, and connects a common feeding point 4 provided on the radiating surface 10*a* to the two radiating patterns 2. By employing such a configuration, the two radiating patterns 2 extending in substantially parallel can be used to radiate electromagnetic waves in mutually different directions.

For example, by arranging the microstrip antenna 1 in FIG. 6A such that the radiating surfaces 10*a* and 10*b* respectively face to the principle surface and end surface of the set of the stacked circuit board 102 and battery 103 inside the electronic device 100, the microstrip antenna 1 can be contained in a tiny space inside the thin casing 110 of the electronic device 100. Accordingly, the electronic device 100 capable of radiating electromagnetic waves in two or more directions can be miniaturized.

The radiating surfaces 10*a* and 10*b* in FIG. 6B are arranged so as to be adjacent to each other through a ridge line 5 that corresponds to short sides of the radiating surfaces 10*a* and 10*b*. Also, each of the radiating surfaces 10*a* and 10*b* is of an elongate shape of which a longer direction is a direction intersecting with the ridge line 5, and on each of the radiating surfaces 10*a* and 10*b*, one radiating pattern 2 is formed. A connecting pattern 3 is formed near the ridge line 5 to connect a common feeding point 4 provided on the radiating surface 10*a* to the two radiating patterns 2. By employing such a configuration, the two radiating patterns 2 intersecting with each other can be used to radiate electromagnetic waves in mutually different directions. Also, the width of the microstrip antenna 1 in the ridge direction can be shortened.

For example, by arranging the microstrip antenna 1 in FIG. 6B along the end surfaces of the set of the stacked circuit board 102 and battery 103 incorporated in the electronic device 100 around an apex angle of the set, the microstrip antenna 1 can be contained in a tiny space inside the thin casing 110 of the electronic device 100 in a state where the radiating surfaces 10*a* and 10*b* are made to face to the two mutually adjacent end surfaces. Accordingly, the electronic device 100 capable of radiating electromagnetic waves in two or more directions can be miniaturized.

FIG. 6C illustrates the case where between the two radiating surfaces 10*a* and 10*b*, a non-radiating surface 10*d* is present. Each of the radiating surfaces 10*a* and 10*b* and non-radiating surface 10*d* is of an elongate shape of which a longer direction is a direction substantially parallel to ridge lines 5, and on the radiating surfaces 10*a* and 10*b*, radiating patterns 2 are respectively formed, whereas on the non-radiating surface 10*d*, no radiating pattern 2 is formed. The radiating surface 10*a* and the non-radiating surface 10*d* are adjacent to each other through a corresponding one of the ridge lines 5, and the non-radiating surface 10*d* and the radiating surface 10*b* are adjacent to each other through the other ridge line 5.

A connecting pattern 3 is formed at one ends of the radiating surfaces 10*a* and 10*b* and non-radiating surface 10*d* in their longer directions, and a feeding point 4 is arranged on the non-radiating surface 10*d*. Even by employing such a configuration, electromagnetic waves can be radiated in two or more directions.

Figure 7:
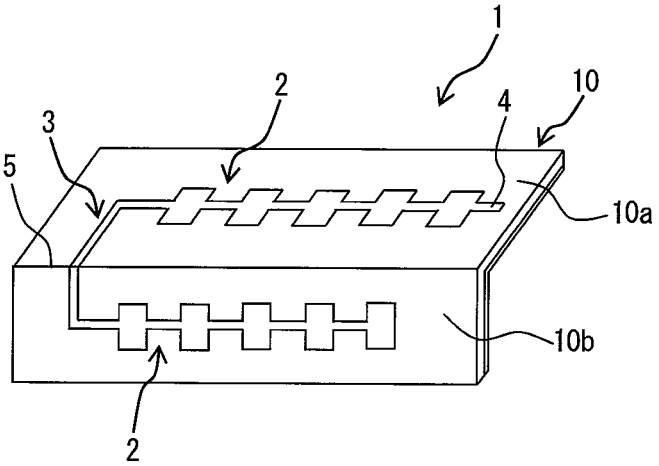
FIG. 7 is a perspective view illustrating still another configuration example of the microstrip antenna 1.

FIG. 7 is a perspective view illustrating still another configuration example of the microstrip antenna 1, and illustrates a dielectric substrate 10 on which one end of a radiating pattern 2 is connected with a feeding point 4, and the other end of the radiating pattern 2 is connected with a connecting pattern 3. In this microstrip antenna 1, the dielectric substrate 10 has two mutually adjacent radiating surfaces 10*a* and 10*b*, and each of the radiating surfaces 10*a* and 10*b* is of an elongate shape of which a longer direction is a direction substantially parallel to a ridge line 5.

On the radiating surface 10*a*, the one radiating pattern 2 is arranged along the ridge line 5, and the one end of the radiating pattern 2 is connected with the feeding point 4, whereas the other end of the radiating pattern 2 is connected with the connecting pattern 3. On the radiating surface 10*b*, one radiating pattern 2 is arranged along the ridge line 5.

The connecting pattern 3 connects the radiating patterns 2 on the respective radiating surfaces 10*a* and 10*b* to each other on the side opposite to the feeding point 4. That is, between the radiating surfaces 10*a* and 10*b*, a feeding direction of a radiating pattern 2 is reversed. Even with such a configuration, in a plane perpendicular to the longer directions of the radiating surfaces 10*a* and 10*b*, sharp directivities can be realized in two different directions.

Note that in the present embodiment, described is an example where the one feeding point 4 is formed on the dielectric substrate 10; however, the present invention can also be applied to the case of providing two or more feeding points 4 on the dielectric substrate 10. Further, in the present embodiment, described is an example where on each of the radiating surfaces 10*a* to 10*c*, one radiating pattern 2 is formed; however, the present invention can also be applied to the case of providing two or more radiating patterns 2 on a radiating surface.

For example, the present invention may be configured to arrange two radiating patterns 2 on a radiating surface in parallel with each other, and connect one ends of feed lines 21 to each other through a connecting pattern 3. Alternatively, the present invention may be configured to arrange two radiating patterns 2 on a radiating surface such that the two radiating patterns 2 extend in mutually opposite directions, and connect the two radiating patterns 2 to each other through a connecting pattern 3.

Also, in the present embodiment, described is an example where by folding the dielectric substrate 10 formed with the radiating patterns 2 and connecting pattern 3, the microstrip antenna 1 is prepared; however, the present invention does not limit a manufacturing method for the microstrip antenna 1 to this.

For example, the present invention may be configured to fold a dielectric substrate 10, which is formed with a ground layer 12 on a back surface and formed with a metal film on a front surface, so as to form a ridge line on the front surface side, and then use photo-etching to pattern the metal film, and thereby form radiating patterns 2 and a connecting pattern 3. Alternatively, the present invention may be configured to fold a dielectric substrate 10, which is formed with a ground layer 12 on a back surface, then form a metal film on the dielectric substrate 10, and pattern the metal film to form radiating patterns 2 and a connecting pattern 3.

Further, in the present embodiment, described is an example where the ground layer 12 is formed so as to cover the entire back surface of the dielectric substrate 10; however, the present invention does not limit the configuration of the ground layer 12, which forms the earth plate for the radiating patterns 2 and connecting pattern 3, to this. For example, in a ground layer 12 covering a back surface of a dielectric substrate 10, a slit is formed along a ridge line 5. The slit is formed in a location facing to the ridge line 5, and of a shape that extends in parallel with the ridge line 5 with keeping a substantially uniform width. For example, the slit is formed from one end surface to the other end surface of the dielectric substrate 10. By forming such a slit in the ground layer 12, a process for folding the dielectric substrate 10 along the ridge line 5 can be facilitated. Note that the present invention may be configured to, instead of forming the one slit from the one end surface to the other end surface of the dielectric substrate 10, form two or more slits with respect to the same ridge line 5, and conduct pieces of the ground layer 12 separated by the slits. By configuring as described, it is possible to suppress the deterioration of radiation characteristics, while facilitating a process for folding the dielectric substrate 10 along the ridge line 5.

The invention claimed is:

1. A microstrip antenna comprising:

two or more radiating patterns for radiating electromagnetic waves; and a connecting pattern for mutually connecting said radiating patterns and feeding electricity from a common feeding point to each of said radiating patterns, wherein:

said radiating patterns and said connecting pattern are respectively adapted as microstrip lines formed on a dielectric substrate;

said dielectric substrate is adapted to be of a flat plate shape that is folded such that a ridge line is formed between two or more radiating surfaces of which normal directions are mutually different;

each of said radiating patterns is formed on said radiating surface different from each other, and includes a feed line and two or more radiating elements; and said connecting pattern intersects with said ridge line to connect said feed lines mutually.

2. The microstrip antenna according to claim 1, wherein:

each of said radiating surfaces is adapted to be of an elongate shape;

said feed line substantially linearly extends in a longitudinal direction of a corresponding one of said radiating surfaces; and said radiating elements are arranged along the feed line.

3. The microstrip antenna according to claim 1, wherein each of said radiating surfaces is adapted to be of an elongate shape of which a longitudinal direction is a direction substantially parallel to said ridge line.

4. The microstrip antenna according to claim 1, wherein each of said radiating surfaces is adapted to be of an elongate shape of which a longitudinal direction is a direction intersecting with said ridge line.

5. The microstrip antenna according to claim 1, wherein said dielectric substrate is made of fluorine resin containing inorganic fiber.

6. The microstrip antenna according to claim 1, wherein a ground layer covering a back surface of said dielectric substrate is formed, and a slit is formed in a location of said ground layer, the location facing to said ridge line.

* * * * *